US011764053B1

(12) United States Patent
Richter et al.

(10) Patent No.: US 11,764,053 B1
(45) Date of Patent: Sep. 19, 2023

(54) LIGHTING ELEMENT

(71) Applicant: mb-microtec ag, Niederwangen bei Bern (CH)

(72) Inventors: Karsten Richter, Bern (CH); Philipp Michel, Gümligen (CH); Remo Pfaff, Urtenen-Schönbühl (CH)

(73) Assignee: mb-microtec ag, Niederwangen bei Bern (CH)

( * ) Notice: Subject to any disclaimer, the term of this patent is extended or adjusted under 35 U.S.C. 154(b) by 0 days.

(21) Appl. No.: 18/046,262

(22) Filed: Oct. 13, 2022

(51) Int. Cl.

| | |
|---|---|
| ***H01J 65/06*** | (2006.01) |
| ***H01J 61/30*** | (2006.01) |
| ***H01J 65/00*** | (2006.01) |
| ***H01J 61/02*** | (2006.01) |
| ***G21H 3/02*** | (2006.01) |
| ***H01J 61/12*** | (2006.01) |
| *F41G 1/34* | (2006.01) |

(52) U.S. Cl.
CPC ..... *H01J 61/302* (2013.01); *G21H 3/02* (2013.01); *H01J 61/025* (2013.01); *H01J 61/12* (2013.01); *H01J 65/00* (2013.01); *F41G 1/345* (2013.01)

(58) Field of Classification Search
CPC ..... F41G 1/345; H01J 65/06
USPC ..... 313/54
See application file for complete search history.

(56) References Cited

U.S. PATENT DOCUMENTS

| | | | | |
|---|---|---|---|---|
| 2011/0107650 | A1* | 5/2011 | Howe | F41G 1/32 42/132 |
| 2011/0249428 | A1* | 10/2011 | Profos | F41G 1/32 362/159 |
| 2017/0321992 | A1* | 11/2017 | Erdle | F41G 1/02 |
| 2018/0010886 | A1* | 1/2018 | Kind | H01J 61/35 |
| 2018/0053575 | A1* | 2/2018 | Karchon | G21F 5/015 |
| 2018/0231350 | A1* | 8/2018 | Howe | F41G 1/14 |
| 2022/0178650 | A1* | 6/2022 | Smith | F41C 33/041 |

FOREIGN PATENT DOCUMENTS

| | | | | |
|---|---|---|---|---|
| WO | 2016124686 | A1 | 8/2016 | |
| WO | WO-2019209535 | A1 * | 10/2019 | F41G 1/01 |

* cited by examiner

*Primary Examiner* — Christopher M Raabe

(57) ABSTRACT

A lighting element with a gaseous tritium light source and an elongated plastic housing that at least partially encloses the gaseous tritium light source with its housing shell and forms a latching element that snaps together with the gaseous tritium light source, which can be inserted into the plastic housing, and holds it in the plastic housing. A rugged lighting element can be produced if the latching element is formed by at least one catch element, which catch element has a radially sprung flexible spring and at least one, preferably two, inwardly oriented snaps with an indentation for snapping together with the gaseous tritium light source.

20 Claims, 4 Drawing Sheets

LIGHTING ELEMENT

FIELD OF THE INVENTION

The invention relates to a lighting element with a gaseous tritium light source and an elongated plastic housing that at least partially encloses the gaseous tritium light source with a housing shell, wherein the plastic housing forms a latching element that snaps together with the gaseous tritium light source, which can be inserted into the plastic housing, and the latching element holds the gaseous tritium light source in the plastic housing.

BACKGROUND OF THE INVENTION

Snapping a gaseous tritium light source (also referred to as a GTLS) to a plastic housing for mechanical protection is known from the prior art. For example, WO2016/124686A1 proposes achieving this by providing the plastic housing of a lighting element with a bead extending circumferentially inside it, with which the inserted gaseous tritium light source produces a snap connection and is thus held in the plastic housing. The mechanical and/or structural design of the plastic housing is disadvantageously subject to strict limits. For example, with regard to a required flaring of the plastic housing during the insertion of the gaseous tritium light source, the latter must remain undamaged. The elasticity of the plastic housing is therefore important to the handling safety during assembly of the lighting element and limits design freedom relative to the lighting element. In addition, the required elasticity of the plastic housing can result in a reduced strength, which has a disadvantageous impact on the protective function of the plastic housing when the gaseous tritium light source is contained in it—and can therefore adversely affect the ruggedness of the lighting element.

The object of the invention, therefore, is to modify the design of a lighting element of the type explained at the beginning in such a way that despite the broad design freedom relative to the lighting element, it can be assembled safely. In addition, the design of the lighting element should be simple and inexpensive to achieve—and should ruggedly protect the gaseous tritium light source from damage.

SUMMARY OF THE INVENTION

Because the latching element is formed by at least one catch element, which catch element has a radially sprung flexible spring and at least one inwardly oriented snap with an indentation for snapping together with the gaseous tritium light source, the design requirements of the plastic housing in the region of the latching element and its other parts can be considered separately from one another. It is thus possible, for example, on the one hand to design the snap connection as correspondingly elastic for a safe and rugged snap connection with the gaseous tritium light source—and on the other hand, to embody the plastic housing so that it is able to withstand a corresponding mechanical strain in order to provide powerful protection of the gaseous tritium light source contained in it. This is particularly the case if the catch element has two inwardly oriented snaps.

According to the invention, it is thus possible to provide a non-damaging and user friendly assembly of the lighting element with a simultaneously rugged protection of the gaseous tritium light source contained in it—while at the same time also affording a high degree of freedom in the structural design of the lighting element.

The design of the lighting element can be further simplified if a section of the housing shell of the plastic housing forms the flexible spring of the latching element.

The foregoing can be further improved if the flexible spring extends in a straight line.

In addition, the at least one snap can be provided at the free end of the flexible spring in order to securely hold the gaseous tritium light source in the plastic housing.

The latching element, following the circular embodiment of the gaseous tritium light source, can hold it in the plastic housing better if the flexible spring has a cylindrically curved surface on its inside. In addition, this structural design can provide a high degree of elasticity during the insertion of the gaseous tritium light source and can thus facilitate the assembly of the gaseous tritium light source.

Preferably, the flexible spring follows a cross-section essentially a shape of a segment of a circular ring in order to thus further increase the ruggedness of the snap connection between the plastic housing and the gaseous tritium light source.

It can turn out to be sufficient if the length ($L_b$) of the flexible spring is in a range from ¼ of a length (L) of the gaseous tritium light source to the maximum length (L) of the gaseous tritium light source in order to thus snap the gaseous tritium light source together with the plastic housing in a rugged way.

In this connection, it can be advantageous if a depth of the indentation (h) is in the range from 3% to 25% of half of the diameter (d) of the gaseous tritium light source.

Preferably, the at least one snap essentially follows a trapezoidal shape in its outer dimensions in the longitudinal section of the plastic housing in order to facilitate the insertion of the gaseous tritium light source and ensure a safe snap connection of the catch element with the gaseous tritium light source.

If the at least one snap additionally has a cylindrically curved head surface in the cross-section of the plastic housing, then it can rest against the outer contour of the gaseous tritium light source over a larger area and thus hold the latter in the plastic housing in a more rugged way.

The foregoing can be further improved if the latching element has a plurality of catch elements that are positioned next to one another in the circumference direction.

It can turn out to be sufficient if the number of catch elements is in the range from 1 to 8, preferably in the range from 2 to 4.

A particularly rugged holding of the gaseous tritium light source can be achieved if the plurality of catch elements form annular segments of the latching element embodied as a segmented annular snap connection between the plastic housing and the gaseous tritium light source.

Preferably, the plastic housing has an opening at a first end for insertion of the gaseous tritium light source (GTLS) into the plastic housing in order to facilitate handling during assembly of the lighting element.

The gaseous tritium light source can be inserted in a particularly simple way if the first end is at least partially formed by the at least one catch element, with the at least one snap defining the opening.

Because the plastic housing has a second end, which is opposite from the first end and constitutes a see-through region made of a transparent plastic, or has an opening, e.g. for a lens, it is possible to adjust the light emission of the gaseous tritium light source in accordance with the requirements. This can contribute to increased visibility of the lighting element. For example, a lens can be inserted into the opening. Other see-through elements are also conceivable, for example a sapphire or a glass plate.

Preferably, except for the second end, the plastic housing consists of a translucent or opaque plastic in order to avoid an emission of light in an unwanted direction.

Preferably, the gaseous tritium light source has a hermetically sealed, more particularly round, glass tube, more particularly made of borosilicate glass, as its outer shell.

More particularly, the lighting element according to the invention can be suitable, for example, for use in a sight for a firearm.

BRIEF DESCRIPTION OF THE DRAWINGS

The subject matter of the invention is shown by way of example in the figures based on multiple embodiment variants. In the drawings.

DETAILED DESCRIPTION OF THE PREFERRED EMBODIMENTS

The lighting elements 1, 2, 3 shown in FIGS. 1 to 5 all have a gaseous tritium light source 4—which is also known as a GTLS in the prior art. This gaseous tritium light source 4 includes a hermetically sealed, round glass tube 4*a* made of borosilicate glass as its outer shell; the glass tube 4*a* is coated on the inside with a luminophore such as zinc sulfide 4*b* and is filled with tritium 4*c*.

Figure 2:
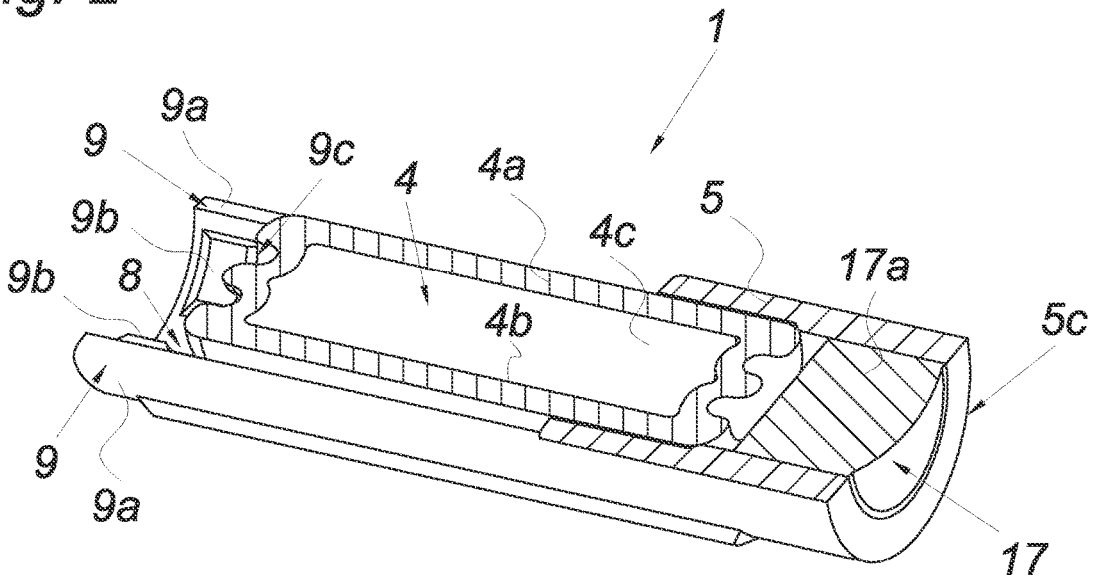
FIG. 2 shows a longitudinal cross-section through FIG. 1.

In all of the lighting elements 1, 2, 3, the gaseous tritium light source 4 is provided in an elongated plastic housing 5, 6, 7 that at least partially encloses the gaseous tritium light source 4 with its housing shell 5*a*, 6*a*, 7*a* and thus protects it from damage. The gaseous tritium light source 4 is held in the plastic housings 5, 6, 7 because they have a latching element 8 that snaps together with the gaseous tritium light source 4, which can be inserted into the respective plastic housing 5, 6, 7—as shown in FIGS. 2, 4, and 5.

According to the invention, the latching element 8 is formed by at least one—in the exemplary embodiment two—catch elements 9, 10. The catch elements 9, 10 each have a radially sprung flexible spring 9*a*, 10*a* and for each flexible spring 9*a*, 10*a*, two inwardly oriented snaps 9*b*, 10*b* with an indentation 9*c*, 10*c* for producing a form-fitting snap connection with the gaseous tritium light source 4. With the catch elements 9, 10 for producing a snap connection between the respective plastic housing 5, 6, 7 and the relevant gaseous tritium light source 4, the structural design of the other sections of the plastic housing 5, 6, 7 can be freely selected. It is thus possible to design the structure of the plastic housing 5, 6, 7 independently of the parameters of the snap connection and thus to improve the protective function of the plastic housing 5, 6, 7. In addition, the catch elements 9, 10 according to the invention enable a user-friendly assembly of the lighting elements 1, 2, 3 and provide a secure hold of the gaseous tritium light sources 4 in the respective plastic housing 5, 6, 7. The lighting elements 1, 2, 3 according to the invention are therefore simple and inexpensive to produce and are particularly rugged during transport and/or in their use—for example in a sight 100 of a firearm 101 shown in FIG. 5.

Figure 1:
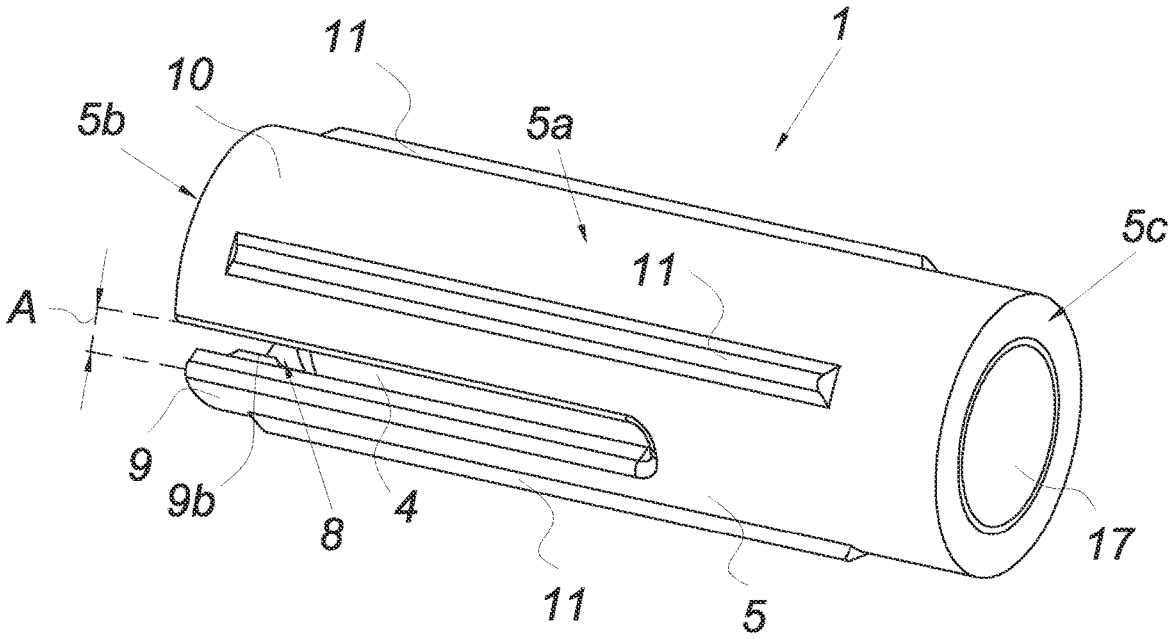
FIG. 1 shows a side view of a lighting element according to a first exemplary embodiment.
Figure 3A:
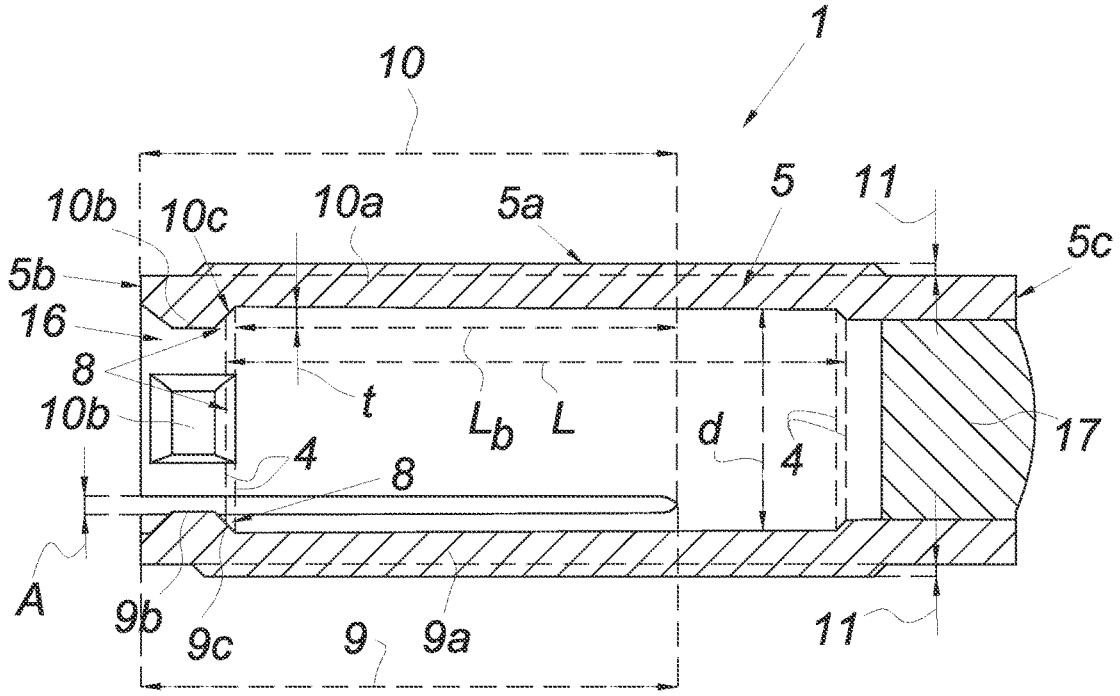
FIG. 3*a* is a view that is rotated relative to FIG. 2 showing two catch elements of the plastic housing, with the gaseous tritium light source 4 indicated by dashed lines.
Figure 3B:
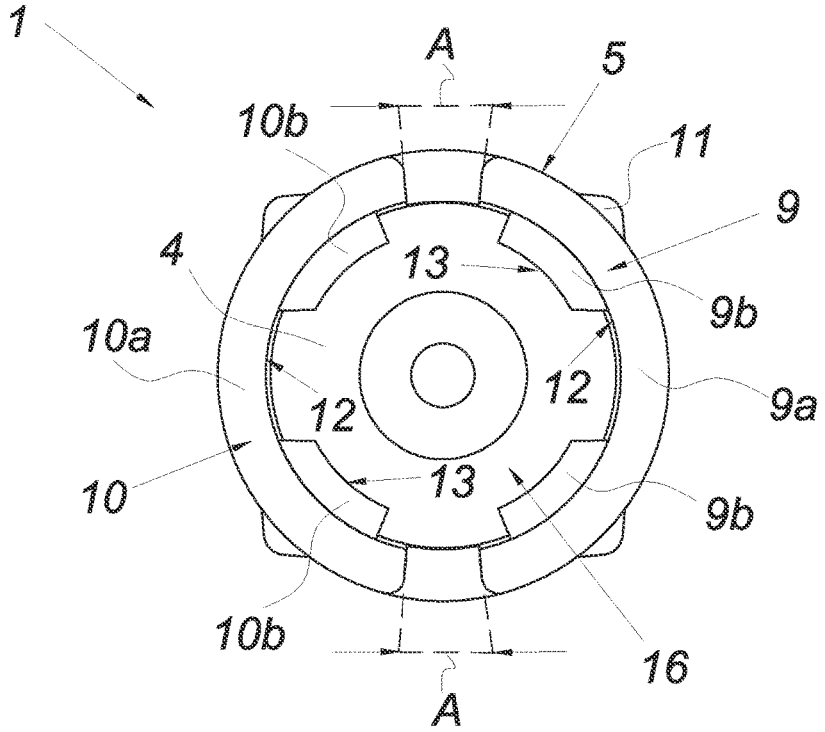
FIG. 3*b* shows an end view of FIG. 1.
Figure 4:
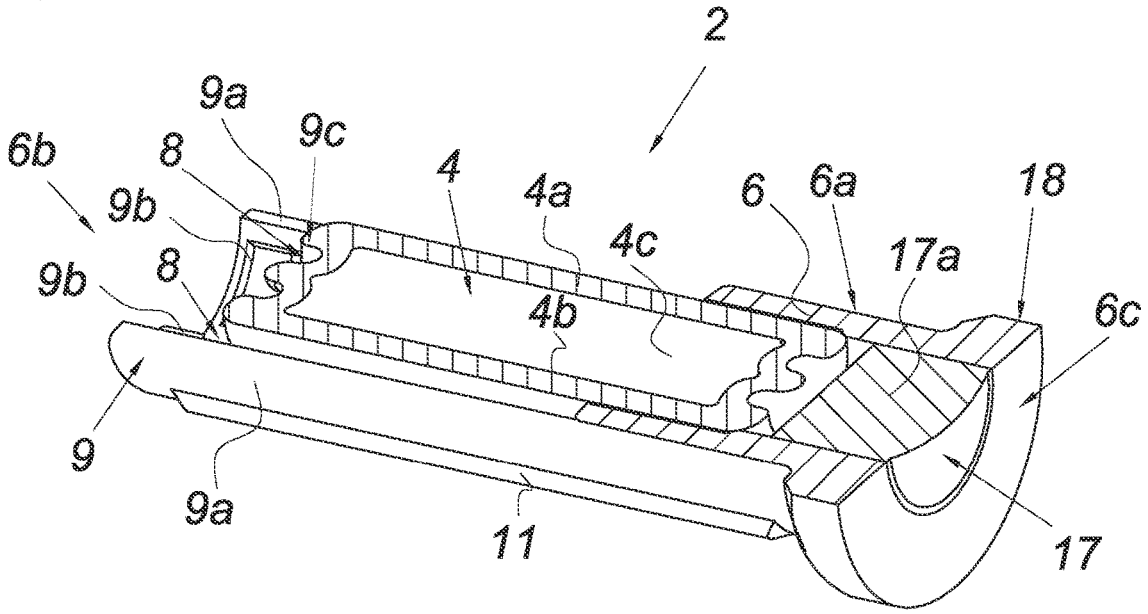
FIG. 4 shows a longitudinal cross-section through a lighting element according to a second exemplary embodiment.
Figure 5:
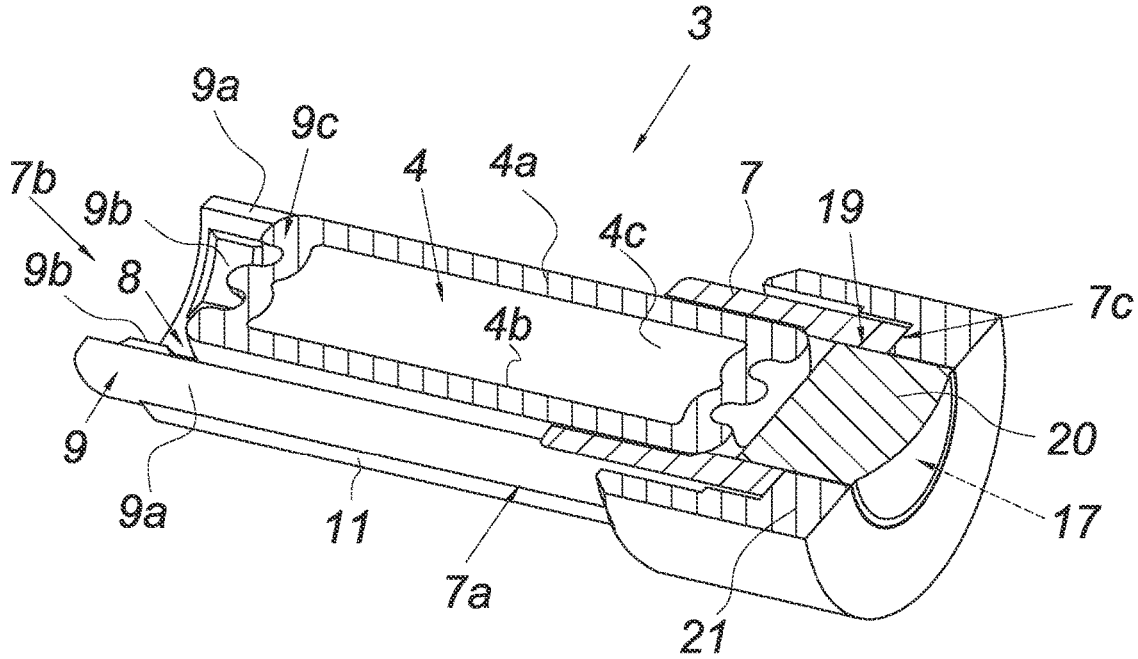
FIG. 5 shows a longitudinal cross-section through a lighting element according to a third exemplary embodiment.

As shown in FIG. 3 for all of the embodiments shown in FIGS. 1, 4, and 5, the housing shell 5*a*, 6*a*, 7*a* of the plastic housing 5, 6, 7 partially forms the flexible spring 9*a*, 10*a* of the latching element 8. The flexible spring 9*a*, 10*a* is thus part of the outer contour of the plastic housing 5, 6, 7—which further simplifies the design of the lighting elements 1, 2, 3.

FIG. 3*a* shows one catch element 9 of the two catch elements 9, 10 in an enlarged exemplary depiction for all lighting elements 1, 2, 3. It is clear that the flexible spring 9*a* extends in a straight line and the snap 9*b* is provided at the free end of the flexible spring 9*a*. The flexible spring 9*a* has a cylindrically curved surface 12 on its inside and outside. This flexible spring 9*a* also has a cross-section that is essentially in the form of a segment of a circular ring. In addition, the length $L_b$ of the flexible spring is approx. 80% of the length L of the gaseous tritium light source 4. The snap 9*b* follows an essentially trapezoidal shape in its outer dimensions in the longitudinal section of the plastic housing 5. The snap 9*b* also has a cylindrically curved head surface 13 in the cross-section of the plastic housing 5, as can be seen in FIG. 3*b*. In addition, the depth t of the respective indentation 9*c*, 10*c* is essentially 15% of half of the diameter d of the gaseous tritium light source 4.

As is clear in FIGS. 1 to 5, the latching element 8 of the respective lighting elements 1, 2, 3 has two respective catch elements 9, 10, which are positioned next to each other in the circumference direction of the plastic housing 5, 6, 7 and spaced apart from each other by the distance A. The catch elements 9, 10 thus form annular segments of the latching element 8 embodied as a segmented annular snap connection between the plastic housing 5, 6, 7 and the gaseous tritium light source 4.

The plastic housings 5, 6, 7 also each have an opening 16 at a first end 5*b*, 6*b*, 7*b* for insertion of the gaseous tritium light source 4 into the plastic housing 5, 6, 7. This first end 5*b*, 6*b*, 7*b* is formed by the catch element 9, 10 in that the snaps 9*b*, 10*b* define this opening 16. The gaseous tritium light source 4 can thus be inserted into the plastic housing 5, 6, 7 in a user friendly way.

The lighting elements 1, 2, 3 are embodied differently from each other at the second ends 5*c*, 6*c*, 7*c* of the relevant plastic housing 5, 6, 7 opposite from the first end 5*b*, 6*b*, 7*b*.

In the first exemplary embodiment of the lighting element 1 shown in FIG. 1, its plastic housing 5 at the second end 5*c* has a see-through region 17 onto the gaseous tritium light source 4. The see-through region 17 consists of a transparent plastic 17*a* and is delineated from the other part of the plastic housing 5, which consists of an opaque plastic.

The lighting element 2 shown as a second exemplary embodiment in FIG. 4 has a plastic housing 6, which in comparison to the plastic housing 5 in FIG. 1, widens out into an outer flange 18 at the second end 6*c*. The outer flange 18 improves visual recognition of the lighting element 2 in daylight, for example when the lighting element 2 is used on a sight 100. Here, too, the plastic housing 6 has a see-through region 17 made of a transparent plastic 17*a*.

The lighting element 3 according to the third exemplary embodiment shown in FIG. 5 has an opening 19 at the second end 7*c* of the plastic housing 7. This opening has a lens 20 inserted into it through which the light emitted by the gaseous tritium light source 4 exits from the plastic housing 7. The lens 20 is held in the opening 19 by a cap 21 made of an opaque plastic that is firmly connected to the plastic housing 7. This cap 21 improves visual recognition of the lighting element 3 in daylight, for example when the lighting element 3 is used on a sight 100. The lens can also be a sapphire.

In an alternative embodiment, it is conceivable—similarly to the first exemplary embodiment according to FIG. 2—for the third exemplary embodiment according to FIG. 5, instead of the opening 19, also to have a see-through region 17 in the plastic housing 7, which is made of a transparent plastic 17*a*, as shown with dashed lines. In all of the exemplary embodiments with the see-through region 17 in the plastic housing 5, 6, 7, it is conceivable for the plastic housing 5, 6, 7 to be produced using a 2-component injection molding process. The see-through region 17 can also be provided in the form of an optical lens.

In the exemplary embodiments, the opaque or translucent plastic can be white, black, yellow, orange, red, green, or of a different color.

Figure 6:
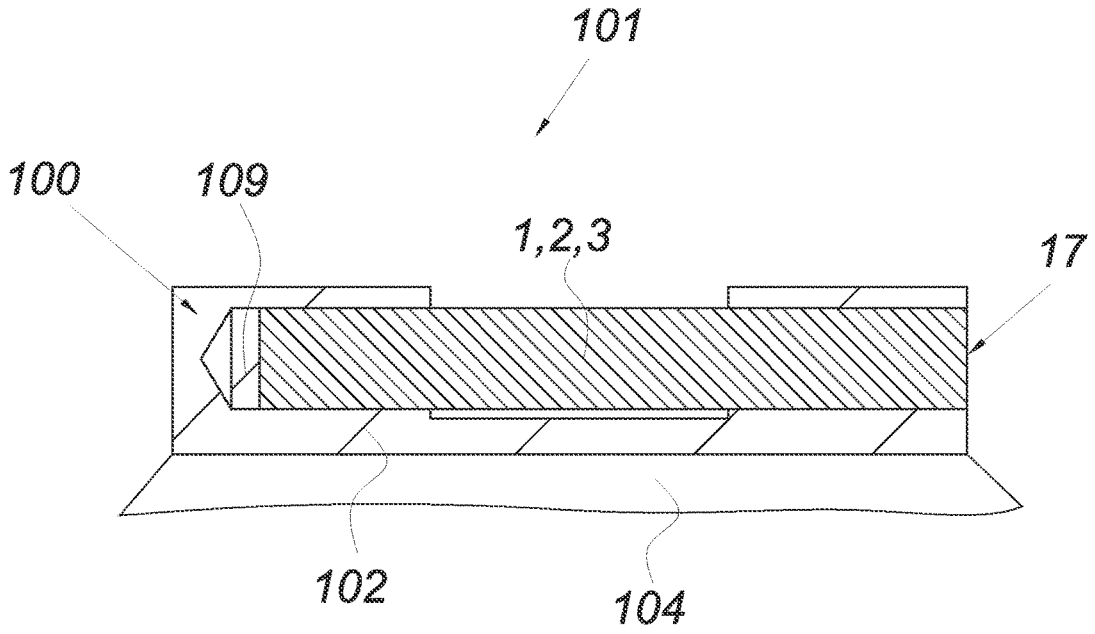
FIG. 6 shows a firearm with a sight that has a lighting element according to FIGS. 1 to 5.

The lighting elements 1, 2, 3 are more particularly suitable for use in sights 100 of firearms 101, as shown in FIG. 6. Preferably, the lighting element 1, 2, 3 is inserted into a metal housing 102 of the sight 100 and glued in place. To accomplish this, the lighting element 1, 2, 3 is bonded to the metal housing 102 with the aid of adhesive 109. The plastic housings 5, 6, 7 ruggedly protect the gaseous tritium light source 4 during transport and when in use; the adhesive 109 also secures the annular snap connection. The sight 100 is provided on a barrel 104 of the firearm 101, as schematically depicted in FIG. 6.

Thanks to the latching element 8 according to the invention, however, it is also possible to replace the gaseous tritium light source 4 or to optionally remove it from the plastic housing 5, 6, 7, which facilitates maintenance and/or recycling.

The ruggedness of the latching element 8 that is snapped together with the gaseous tritium light source 4 is significantly increased by means of a plurality of protruding ribs 11 provided on the plastic housing 5, 6, 7. In addition or alternatively, these ribs 11 can serve to ensure a definite adhesive gap, for example in the recess 102 of the sight 100, for example if the plastic housing 5, 6, 7 is provided in a recess.

The descriptions and figures included herein depict specific implementations to teach those skilled in the art how to make and use the best option. For the purpose of teaching inventive principles, some conventional aspects have been simplified or omitted. Those skilled in the art will appreciate variations from these implementations that fall within the scope of the invention. Those skilled in the art will also appreciate that the features described above can be combined in various ways to form multiple implementations. As a result, the invention is not limited to the specific implementations described above, but only by the claims and their equivalents.

The invention claimed is:

1. A lighting element, comprising:

a gaseous tritium light source; and an elongated plastic housing that at least partially encloses the gaseous tritium light source with a housing shell, wherein the plastic housing forms a latching element that snaps together with the gaseous tritium light source, which can be inserted into the plastic housing, and the latching element holds the gaseous tritium light source in the plastic housing, wherein the latching element is formed by at least one catch element, which catch element has a radially sprung flexible spring and at least one inwardly oriented snap with an indentation for snapping together with the gaseous tritium light source.

2. The lighting element according to claim 1, wherein a section of the housing shell of the plastic housing forms the flexible spring of the latching element.

3. The lighting element according to claim 1, wherein the flexible spring extends in a straight line and/or the at least one snap is provided at a free end of the flexible spring.

4. The lighting element according to claim 1, wherein the flexible spring has a cylindrically curved surface on its inside and/or outside.

5. The lighting element according to claim 1, wherein the flexible spring in cross-section essentially follows a shape of a segment of a circular ring.

6. The lighting element according to claim 1, wherein a length of the flexible spring is in a range from ¼ of a length of the gaseous tritium light source to a maximum length of the gaseous tritium light source and/or a depth of the indentation is in a range from 3% to 25% of half of a diameter of the gaseous tritium light source.

7. The lighting element according to claim 1, wherein the at least one snap follows an essentially trapezoidal shape in its outer dimensions in a longitudinal section of the plastic housing and/or the at least one snap has a cylindrically curved head surface in a cross-section of the plastic housing.

8. The lighting element according to claim 1, wherein the latching element has a plurality of catch elements that are positioned next to one another in a circumference direction of the plastic housing.

9. The lighting element according to claim 8, wherein the number of catch elements is in a range from 1 to 8.

10. The lighting element according to claim 8, wherein the plurality of catch elements form annular segments of the latching element embodied as a segmented annular snap connection between the plastic housing and the gaseous tritium light source.

11. The lighting element according to claim 1, wherein the plastic housing has an opening at a first end for insertion of the gaseous tritium light source into the plastic housing.

12. The lighting element according to claim 11, wherein the first end is at least partially formed by the at least one catch element, with the at least one snap defining the opening.

13. The lighting element according to claim 11, wherein the plastic housing has a second end, which is opposite from the first end and constitutes a see-through region made of a transparent plastic, or has an opening.

14. The lighting element according to claim 13, wherein, except for the second end, the plastic housing consists of a translucent or opaque plastic.

15. The lighting element according to claim 13, wherein the opening in the second end accommodates a lens or other see-through element.

16. The lighting element according to claim 1, wherein the gaseous tritium light source has a hermetically sealed glass tube as its outer shell.

17. The lighting element according to claim 16, wherein the hermetically sealed glass tube is round.

18. The lighting element according to claim 16, wherein the hermetically sealed glass tube is made of borosilicate glass.

19. A sight with the lighting element according to claim 1.

20. A firearm with the sight according to claim 19.

* * * * *